US009042063B2

(12) United States Patent
Normoyle et al.

(10) Patent No.: US 9,042,063 B2
(45) Date of Patent: May 26, 2015

(54) SWITCHING ARRANGEMENT

(75) Inventors: Brendan Normoyle, Castlemahon (IE); Philip Foxley, Conwy (GB); Melvyn McGann, Chelmsford (GB); Leslie Allen, Clacton-on-Sea (GB)

(73) Assignees: Tyco Electronics UK Ltd., Swindon, Wiltshire (GB); Raychem International (Irish Branch), Limerick (IE)

( * ) Notice: Subject to any disclaimer, the term of this patent is extended or adjusted under 35 U.S.C. 154(b) by 13 days.

(21) Appl. No.: 13/995,860

(22) PCT Filed: Dec. 20, 2010

(86) PCT No.: PCT/GB2010/052151

§ 371 (c)(1), (2), (4) Date: Nov. 12, 2013

(87) PCT Pub. No.: WO2012/085492

PCT Pub. Date: Jun. 28, 2012

(65) Prior Publication Data

US 2014/0055219 A1 Feb. 27, 2014

(51) Int. Cl.

| | |
|---|---|
| ***H01H 9/56*** | (2006.01) |
| ***H01H 9/54*** | (2006.01) |
| *H01H 47/00* | (2006.01) |
| *H01H 50/02* | (2006.01) |

(52) U.S. Cl.

CPC ..... *H01H 9/542* (2013.01); *H01H 9/56* (2013.01); *H01H 9/541* (2013.01); *H01H 47/00* (2013.01); *H01H 50/021* (2013.01)

(58) Field of Classification Search

CPC ..... H01H 9/542; H01H 9/541; H01H 9/56
USPC ..... 361/7, 5, 6
See application file for complete search history.

(56) References Cited

U.S. PATENT DOCUMENTS

| | | | | |
|---|---|---|---|---|
| 3,355,647 | A * | 11/1967 | Brans | 318/807 |
| 3,487,231 | A * | 12/1969 | Dixon, Jr. | 307/113 |
| 3,560,824 | A * | 2/1971 | Burke | 318/806 |
| 3,601,658 | A * | 8/1971 | Manners | 361/31 |
| 6,208,117 | B1 * | 3/2001 | Hibi | 320/134 |
| 6,969,927 | B1 | 11/2005 | Lee | |
| 7,385,791 | B2 * | 6/2008 | Ness | 361/8 |
| 7,660,083 | B2 * | 2/2010 | Yao et al. | 361/8 |
| 8,067,920 | B2 * | 11/2011 | Choi et al. | 318/785 |
| 8,482,885 | B2 * | 7/2013 | Billingsley et al. | 361/8 |
| 2008/0048807 | A1 | 2/2008 | Yao et al. | |

OTHER PUBLICATIONS

International Search Report and Written Opinion issued by the European Patent Office, dated Aug. 31, 2011, for related International Application No. PCT/GB2010/052151; 8 pages.

* cited by examiner

*Primary Examiner* — Zeev V Kitov
(74) *Attorney, Agent, or Firm* — Faegre Baker Daniels LLP

(57) ABSTRACT

A switching arrangement is disclosed comprising: a control circuit; a latching relay controlled by the control circuit for connecting an AC source to an AC load; and a relief circuit in parallel with the relay and controlled by the control circuit. The relief circuit has two modes of operation: an inactive mode in which the relief circuit is non-conductive and an active mode in which the relief circuit is at least partially conductive. The relief circuit is partially conductive when spending both a time period in a conductive state and a time period in a non-conductive state during a half-cycle of the AC. The control circuit is configured to switch the relief circuit from inactive mode to active mode, and upon switching to active mode, to set the relief circuit as partially conductive for at least two half-cycles, wherein the proportion of time the relief circuit is conductive compared to non-conductive is increased for successive ones of the at least two half-cycles.

14 Claims, 4 Drawing Sheets

SWITCHING ARRANGEMENT

FIELD OF THE INVENTION

The present invention relates to a switching arrangement comprising a relay for connecting an AC source to an AC load.

BACKGROUND TO THE INVENTION

One of the fundamental issues in high power AC switching applications is the large arc or flashover generated when making or breaking any switching contacts on load. This arc is caused by the switch attempting to open or close at any random part of the AC sine wave cycle and therefore inadvertently switching the full load current.

The undesirable effects of switching at random points in the AC cycle are made worse if the circuit being switched exhibits a poor power factor, that is, either the AC source or the AC load contain reactive elements.

Due to its somewhat explosive nature and high temperature, this arc can cause significant erosion of the switching contacts which, at best, can shorten the contact life or in extreme circumstances, can weld the contacts permanently closed. Both of these are considered serious switch failures. Ideally, for maximum lifetime, the switch should always operate at the zero crossing point in the sine cycle. However, this is not always possible due to delay or latency between the switch contacts reacting to a control signal in automated switching and the random nature of manual switching (e.g. inserting a switching link). Conventional techniques employed by power switch manufacturers to reduce arcing include the use of mechanical bellows to draw the arc away from the switch contacts and the use of inert gases to extinguish the arc at source.

US 2008/0048807 discloses an arrangement with an AC relay and a triac connected in parallel to one another, the triac being turned on just before and turned off just after the contacts of the AC relay are opened or closed. The triac is turned on and off at the zero crossings of the AC to minimise power surges, and aims to prevent arcing across the mechanical contacts of the AC relay.

The minimisation of power surges is important to help protect load components, and to prevent excessive current from flowing under faulty load conditions, for example a short-circuit. Loads typically comprise some form of protection circuitry such as a fuse at the input, although an excessive level of current may still flow during the time before the fuse blows, and the source power supply may still be adversely affected.

SUMMARY OF THE INVENTION

In accordance with the present invention, there is provided a switching arrangement comprising: a control circuit, a latching relay controlled by the control circuit for connecting an AC source to an AC load; and a relief circuit 12 in parallel with the relay and controlled by the control circuit, wherein the relief circuit has two modes of operation: an inactive mode in which the relief circuit is non-conductive and an active mode in which the relief circuit is at least partially conductive, wherein the relief circuit is partially conductive when spending both a time period in a conductive state and a time period in a non-conductive state during a half-cycle of the AC. The control circuit is configured to switch the relief circuit from inactive mode to active mode, and upon switching to active mode, to set the relief circuit as partially conductive for at least two half-cycles, wherein the proportion of time the relief circuit is conductive compared to non-conductive is increased for successive ones of the at least two half-cycles.

The increase of the proportion of time the relief circuit is conductive compared to non-conductive for successive half-cycles, results in a progressive increase in the level of current that is supplied to the load after changing from the inactive mode to the active mode.

Advantageously, the relief circuit may be conductive for a first period of time within a first half-cycle after changing to the active mode, conductive for a second period of time within a second half-cycle later than the first half-cycle, and conductive for a third period of time within a third half-cycle later than the second half-cycle, the second period of time being longer than the first period of time and the third period of time being longer than the second period of time.

The third half-cycle may be immediately after the second half-cycle, and the second half-cycle may be immediately after the first half-cycle. Alternately, the increase in the conduction period for successive half cycles can comprise one or more half cycles each having a first conduction period followed by one or more half cycles each having a second, longer, conduction period. For example, the two half-cycles of the first AC cycle may each have a conduction time of 5% of the half-cycle time, and the two half-cycles of the second AC cycle following the first AC cycle may each have a conduction time of 10% of the half-cycle time.

The control circuit may be configured to control the switching of the relay on or off whereby (i) immediately prior to switching the relay, the control circuit switches the relief circuit from inactive mode to active mode and (ii) immediately after switching the relay, the control circuit switches the relief circuit from active mode to inactive mode.

This means that the relief circuit is conductive in the active mode only for a limited period of time, and therefore is less likely to reach any thermal limit. The minimum time that the relief circuit is in the active mode is generally set by the time taken for the relay, from when it was activated, to complete its operation. However, the active mode may be extended to a duration corresponding to more AC cycles (e.g. 2, 10 or 20). The maximum number would be set by the heating effects within the thyristors, and so for this reason, the duration is generally kept to the minimum.

In the active mode, the relief circuit may switch from conductive to nonconductive states coincident with the zero-crossing of the AC. For example, this can be achieved by a switching arrangement wherein the relief circuit comprises a thyristor pair, the thyristors connected with polarities reversed and in parallel; and wherein, in the active mode, the control circuit outputs a burst of pulses, each pulse initiating conduction of the thyristors pair until the following zero-crossing of the AC. Alternatively, a high-frequency signal such a square wave may be used.

The switching arrangement may employ abnormal or short-circuit load protection for the purpose of preventing damage to both the switch and the external circuits. When the switching arrangement is switched on, in the active mode, the relief circuit switches back and to between conductive and non-conductive states whereby the proportion of time the relief circuit is conductive compared to non-conductive increases for successive half-cycles. Ideally, the relief circuit would switch from conductive to non-conductive states at each zero-crossing of the AC applied to the switching arrangement wherein the proportion of time the relief circuit is conductive compared to non-conductive is increased for successive AC cycles by switching from non-conductive to conductive states progressively earlier in successive AC cycles. Thus, a fault in the load may be detected at an early stage before the conductive proportion of time is increased to a level where the current may rise sufficiently for damage to occur.

Where the switching arrangement further comprises an over-current detection circuit, excessive current in the Active Mode when the switching arrangement is to be switched on and the relay closed may be detected, and the over-current detection circuit may output a corresponding signal to the control logic to abort the Active Mode and the closing of the relay.

BRIEF DESCRIPTION OF THE DRAWINGS

The invention will now be described, by way of example only, with reference to the following figures in which.

DETAILED DESCRIPTION

Figure 1:
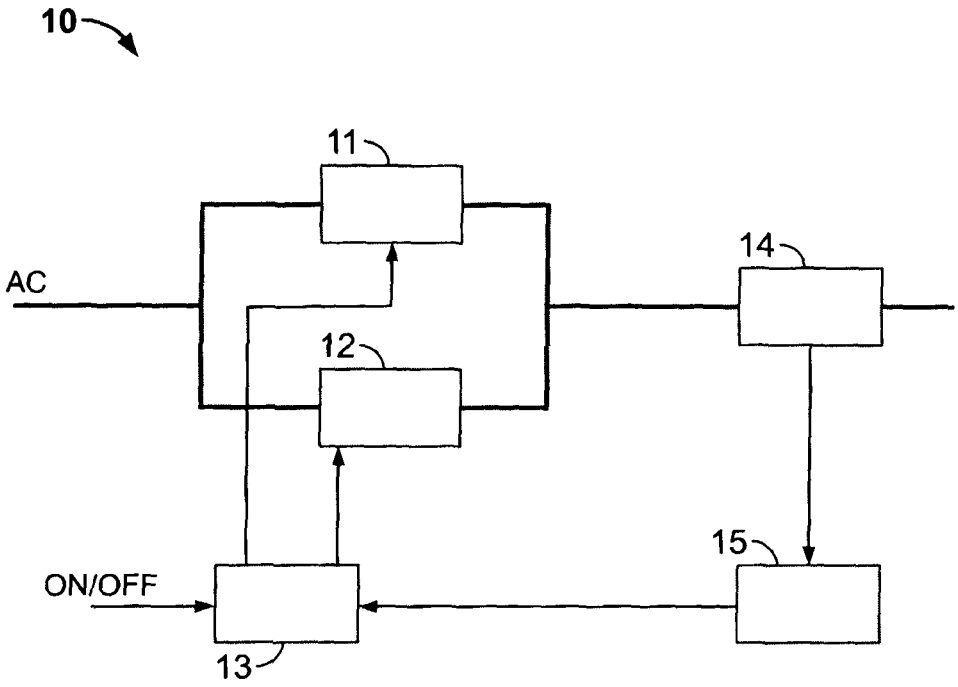
FIG. 1 shows, schematically, a switching arrangement according to an embodiment of the present invention.

Referring to FIG. 1, a high power AC switching circuit 10 according to the present invention is shown schematically in which a latching relay 11 is connected between the AC source (not shown) and an AC load (not shown). The latching relay is controlled by control logic 13 which itself is controlled by a relay ON/OFF signal provided from an external source. In parallel with the latching relay 11 is a thyristor module 12 composed of thyristor pair connected with polarities reversed and in parallel. The thyristor module is controlled by the control logic 13, one of the thyristors for conducting current during positive AC half-cycles and the other of the thyristors for conducting current during the negative AC half-cycles.

Hereafter, the term "switch" is intended to refer to the whole structure, that is, the complete means for connecting the AC source to the AC load.

Figure 2A:
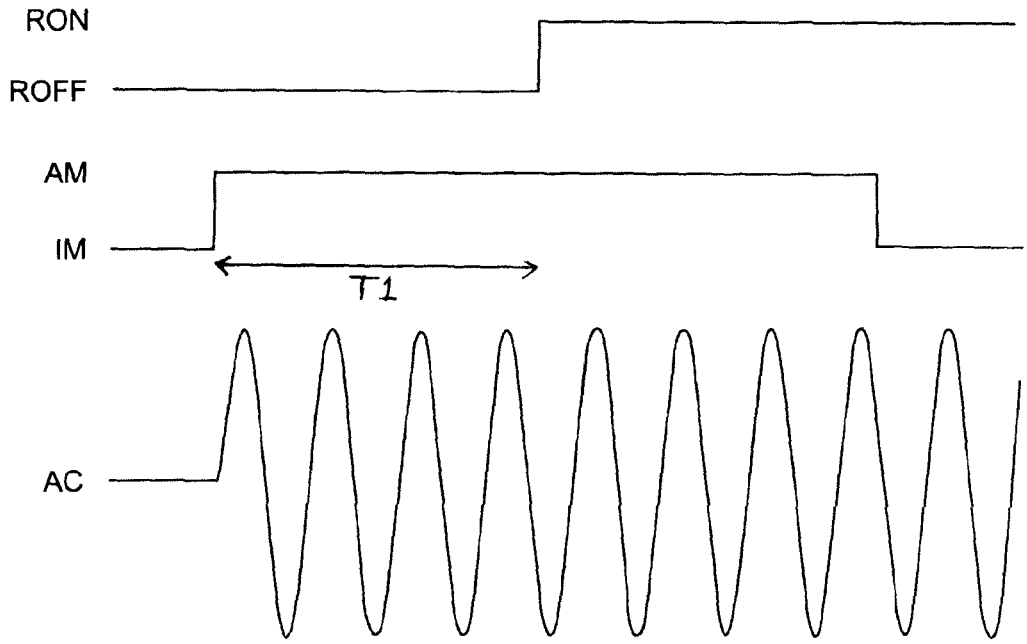
FIGS. 2*a* and 2*b* illustrate the operation of the switching arrangement of FIG. 1.
Figure 2B:
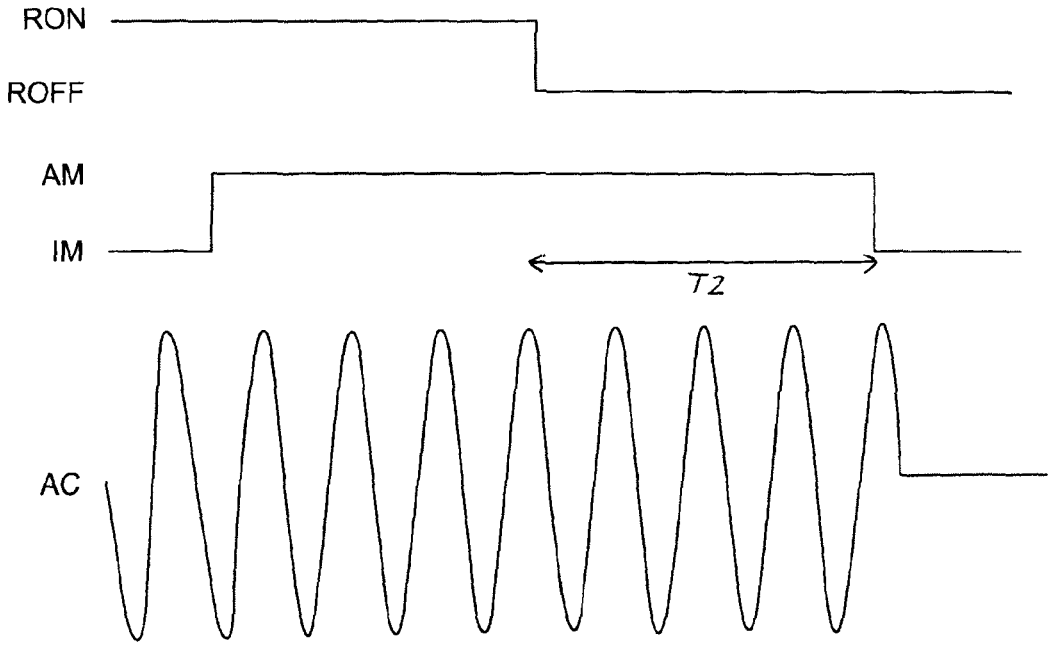

FIGS. 2A and 2B illustrate the high level behaviour of the switching circuit 10 when a Switch "ON" signal is provided to the control logic 13 (FIG. 2A) and a Switch "OFF" signal is provided to the control logic 13 (FIG. 2B).

Referring to FIG. 2A, IM and AM represent an Inactive Mode and an Active Mode of the thyristor module 12. Prior to receiving a Switch "ON" signal, the thyristor module resides in the Inactive Mode whereby the thyristor module is non-conductive. ROFF and RON represent the OFF (open) and ON (closed) status of the relay 11. As the relay is OFF (i.e. open), there is no AC current flow.

Upon receiving a Switch ON signal, control logic 13 causes the thyristor module 12 to change to an Active Mode in which the thyristor module switches "ON". Accordingly, AC current flow begins to flow through the thyristor module. At the same time, a "close" command is sent to the relay, starting its closure process. Current continues to flow in the thyristors until a small number of AC cycles later, when the control logic 13 senses that the relay 11 has closed. The control circuit then removes the drive to the thyristors at the first available zero-crossing after this has occurred. Therefore, the thyristor module 12 reverts to the non-conducting, Inactive Mode. However, as the relay is now ON (i.e. closed), AC current now flows through the relay, and the switch is now "ON". In this scenario, the relay has closed in an "off load" condition, and so there is no arc flashover to damage the relay contacts.

Referring to FIG. 2B, prior to receiving a Switch OFF signal, relay 11 is ON (i.e. closed) and there is AC current flowing through the relay. The thyristor module 12 resides in the non-conductive, Inactive Mode.

Upon receiving a Switch OFF signal, control logic 13 causes the thyristor module 12 to change to an Active Mode in which the thyristor module is in a "latent" conduction mode, so that it can conduct AC current as soon as the relay contacts open. The control logic 13 sends a burst of pulses to the thyristor module to turn the thyristors on at the zero crossings of the AC current and keep the thyristors in a conductive state. At the same time, control logic 13 sends an "open" command to the relay, starting its opening process. AC current continues to flow in the relay until, after a few AC cycles, the relay opens. Immediately, the AC current begins to flow through the thyristor module.

Control logic 13 will now have detected that the relay contacts have opened, and at or just prior to the first subsequent AC zero-crossing will remove the drive from thyristor module 12. This causes the thyristor module 12 to revert to the nonconducting, Inactive Mode at the zero of AC current. As the relay is OFF (i.e. open), no AC current flows through the relay, and so the switch is now "OFF". In this scenario, the relay has opened in an "off load" condition, and so there is no arc flashover to damage the relay contacts.

As mentioned, the thyristor module 12 is controlled by the control logic 13. More particularly, in the Active Mode, the control logic outputs signals to render the thyristor module conducting. Each zero-crossing of the AC renders the thyristor module non-conducting until a subsequent pulse or drive signal is received, due the normal characteristics of thyristor operation, whereupon the device switches "off" when the current through it approaches zero.

The relief circuit may comprise a thyristor pair connected with polarities reversed and in parallel, and wherein, in the active mode, the control circuit outputs a burst of pulses, each pulse to initiate conduction of the thyristors pair until the following zero-crossing of the AC.

As an alternative to a burst of pulses to initiate conduction as is used conventionally to switch on thyristors, a high-frequency signal such a square wave may be used. This would allow for simpler implementation of the coupling arrangement to the thyristor gates, generally using a transformer to provide voltage isolation. Also, when the switch is changing from "ON" to "OFF", it is essential for the relief circuit incorporating the thyristors to be in a conducting state prior to the relay opening, even though the precise time when this occurs is unknown. A high frequency gate drive would ensure that the thyristors are in a "latent" conductive state, and will conduct as soon as current flows through them instead of through the opening relay. Such a gate drive signal could be obtained by gating the output from a high-frequency source with a logic signal that defines the "ON" time required of the thyristors.

The use of an isolating transformer between the control circuit 13 and the relief circuit 12 enables the AC path through the switching circuit to be completely isolated from the control circuit 13, for improved safety and reduced EMC interference.

The use of a latching relay enables a lower power consumption as the relay does not have to be continuously driven to hold it in the correct state. Since the relay is not continuously driven, the relay 11 incorporates auxiliary contacts which may be either in the form of a mechanical switch or an optical interrupter device, the purpose of which is to inform the control circuit 13 which state the relay is in, the auxiliary contacts being connected to the control circuit 13.

The switching arrangement of FIG. 1 can incrementally increase the conduction of the thyristor module 12 during the period T1 (shown in FIG. 2A), between the control circuit 13 changing the thyristor module 12 to an Active Mode and the relay 11 being turned on. This incremental increase is achieved by increasing the time for which the thyristor module is conductive in successive AC cycles, and may enable abnormal or short-circuit load protection.

When a Switch "ON" command is received, control logic 13 causes the thyristor module 12 to change to an Active Mode in which the thyristor module switches "ON" in a way such that the proportion of time that the thyristor module 12 is conductive compared to non-conductive is increased for successive cycles of the AC by driving progressively earlier relative to the following zero-crossing over successive AC cycles. The result is that current will flow in the thyristors as illustrated in FIGS. 3A and 3B, wherein a Switch "ON" signal is provided to the control logic 13, and illustrated is the AC current after the Active Mode of the thyristor module 12 has been initiated but prior to the relay 11 being switched ON (i.e. closed).

Figure 3A:
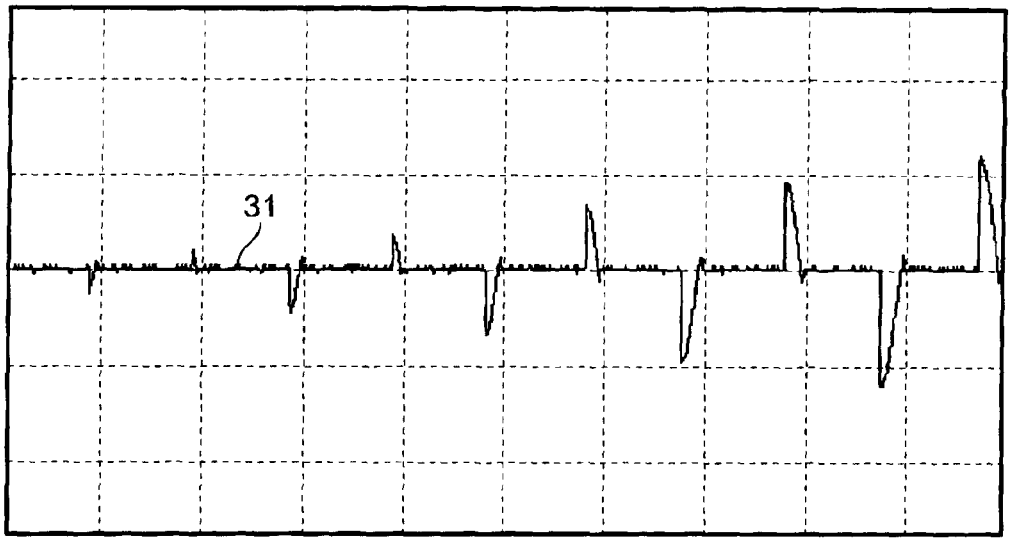
FIGS. 3*a* and 3*b* illustrate operation of the switching arrangement of FIG. 1 during the time period T2 shown in FIG. 2A.
Figure 3B:
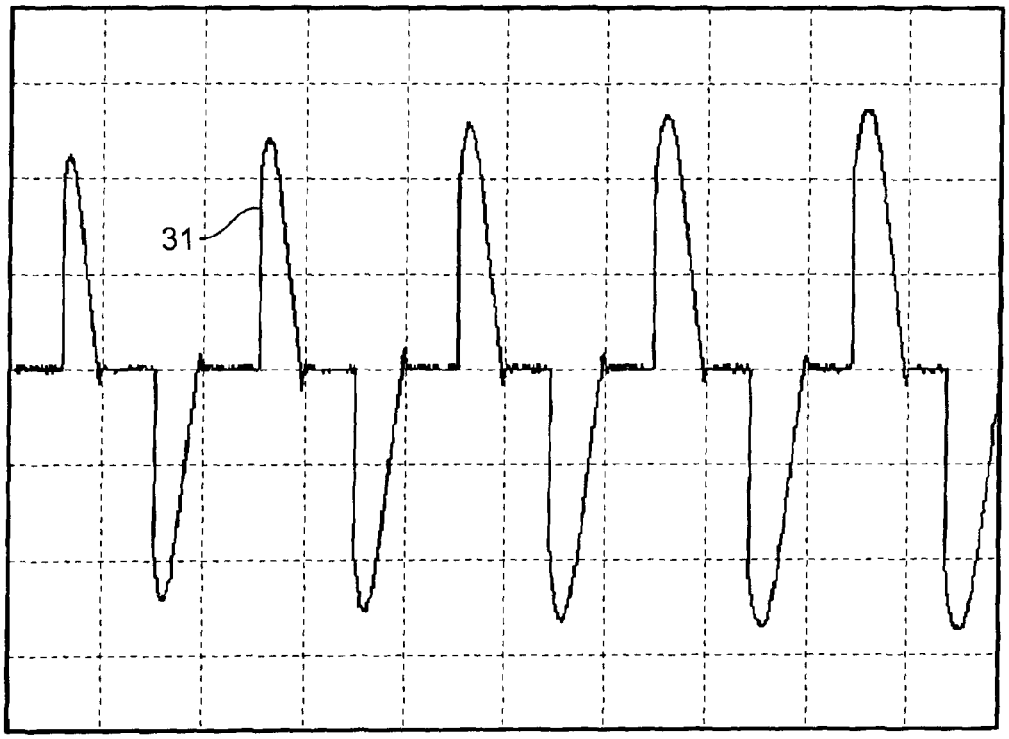

Specifically, FIG. 3A illustrates change in current flow at the initiation of the Active Mode where the thyristor module is rendered conductive for only a short period before the following zero-crossing but where this period increases; and FIG. 3B illustrates the same midway through the sequence. Because the thyristor conduction period increases gradually through the sequence, the current flowing into the load will progressively increase from a small value at the start to the normal full load current at the end of the sequence. Should an abnormal load current be detected at any point in this sequence, the sequence can be aborted before any damage occurs. Under no-fault conditions, the sequence continues until the thyristor module is fully conducting over the complete AC cycle. At this time, control logic 13 will apply a "close" command to the relay. When the control logic 13 detects that the relay has closed, it removes the drive signal from the thyristor module 12, and so the AC current now flows only through the relay. The switch is now "ON". In this scenario, the relay has closed in an "off load" condition, and so there is no arc flashover to damage the relay contacts.

The progressive increase in current through the thyristor module 12 may have advantages in slowly ramping up the current provided to the load, and avoiding the stress on the load components that may occur by immediately changing from zero current to full current. The progression of driving earlier and earlier relative to the following zero-crossing over successive AC cycles comprises switching the thyristor module ON for a first period of time within each one of a first given number of half-cycles after changing from the inactive mode to the active mode, and switching the thyristor module ON for a second period of time within each one of a second given number of half-cycles subsequent to the first given number of half cycles, wherein the second period of time is longer than the first period of time. Further given numbers of half cycles may follow the second number of given half cycles until the thyristor module is switched ON for the full time durations of the half cycle. The first, second, and further given numbers may for example be 1 so that each half-cycle has a longer conduction time than the half-cycle that preceded it. The timing diagrams of FIG. 3A and FIG. 3B illustrate the case when the first, second, and further given numbers are all equal to 2. The first, second, and third given numbers of half-cycles may in an alternate embodiment differ from one another according to the required rate of progression.

A similar progressive reduction in the load current may optionally be implemented in the time period T2 (shown in FIG. 2B). When a Switch "OFF" command is received, control logic 13 may cause the thyristor module 12 to reduce the proportion of time that the thyristor module 12 is conductive compared to non-conductive for successive cycles of the AC by driving progressively later relative to the following zero-crossing over successive AC cycles.

The embodiment of FIG. 1 further comprises a current sensing device 14 which provides sensor data to an over-current detection circuit 15. For example, a current transformer or a Hall-Effect device could be used, but whatever means is used, it must have sufficient bandwidth to respond accurately to the narrow current pulses that may occur at the start of the Active Mode. Otherwise, the response to a potentially severe overload condition could take too long.

Fault conditions, that is, abnormal currents occurring when switching from OFF to ON, may for example be detected as follows.

A first means of detection is by direct comparison of the peak level of the current signal, on a cycle-by cycle basis, with a predetermined reference value.

The second means of detection is by the detection of the absolute peak amplitudes of successive pulses as shown in FIG. 3A, and then performing a calculation to establish the rate of rise of the current. This can be compared to a predetermined value. Clearly this method is most easily implemented by a software algorithm.

In the event of a fault condition being detected, the Active Mode can be aborted thereby preventing overheating and/or damage to the thyristor module. In addition, the closing of the relay will be prevented because the sequence will not proceed to that point. The closing of the switch into a fault condition has therefore been prevented.

Figure 4:
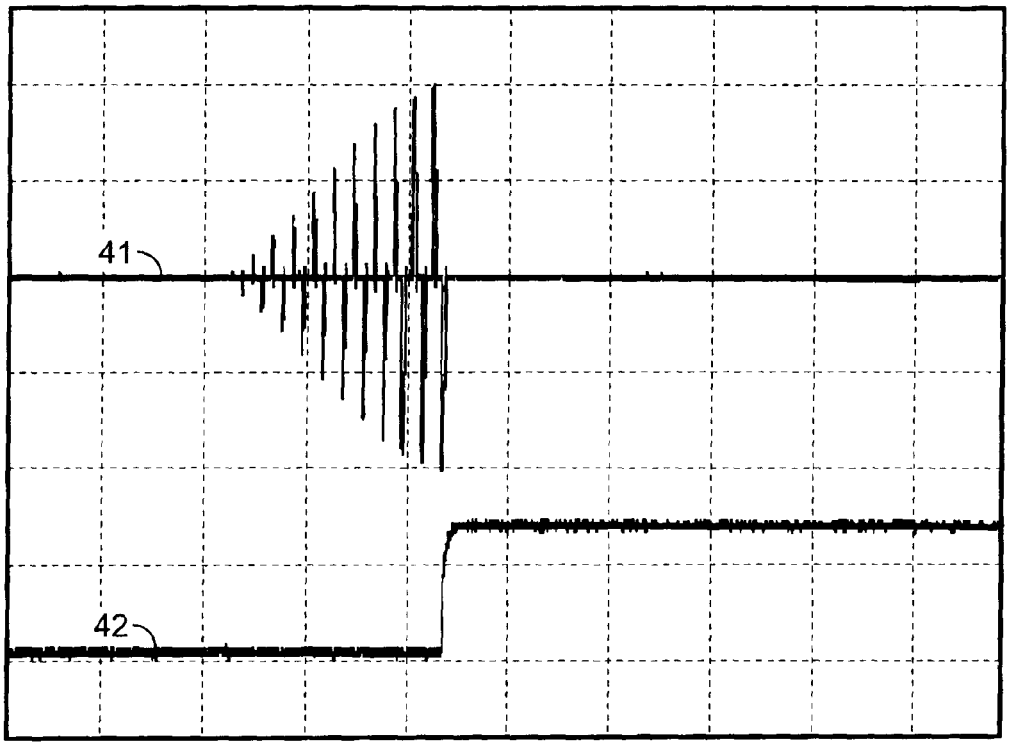
FIG. 4 illustrates a response of the switching arrangement employing abnormal or short-circuit load protection when an over-current condition is detected.

Response to an over-current condition is illustrated in FIG. 4 in relation to the scenario when a Switch ON signal is provided to the control logic 13 and also where the proportion of time that the thyristor module 12 operating in the Active Mode is rendered conductive compared to non-conductive is increased for successive AC cycles. Specifically, plot 41 represents the current flow through the thyristor module and into the AC load prior to detection of an over-current condition, and plot 41 represents the output of a corresponding signal 42 from the over-current detection circuit 15 to the control logic for the purpose of enabling the control logic to abort the Active Mode and prevent closure of the switch.

The switch may also be protected against abnormal or short-circuit load conditions occurring when it is closed, using the same current-sensing hardware means described above. In this case, the output from the current-sensing means is processed in two ways.

The first is the measurement of the absolute value of the current in the switch at any instant. This is compared with a predetermined reference value to establish whether or not a fault condition is present.

The second is to derive from the current-sensing means a signal corresponding to the rate of rise of the current on an individual half-cycle basis. This can then be used to predict what the maximum value of the current in that half-cycle will be, and so determine if a fault condition is present. This arrangement relies on the predictable shape of the AC current to establish a future maximum value from the measured signal. The reason for using this second method is that it allows the detection of fault conditions in the shortest possible time, as the current need not necessarily have reached the unsafe value when the condition is detected. In practice, a combination of the two detection methods may be used, by summing the two signals in a variable proportion and comparing the result with a predetermined maximum value.

Those skilled in the art will appreciate that the two methods of fault detection may be performed purely as a hardware task, but are likely to prove more convenient to implement as a software routine in the switch controller, provided that sufficient speed is available for processing.

When the switch is in the closed state and a fault condition is detected, the normal switch "open" sequence will be immediately activated so that the faulty load will be disconnected from the source as quickly as possible. However, in the event that the fault current is predicted as described above to be in excess of the current rating of the thyristors, the switch control logic will be arranged not activate the "open" sequence, and so will maintain the contactor in a "closed" condition and not turn on the thyristors. This prevents damage to the switch. In this event, the fault current will be interrupted by some external means in the circuit, for example a fuse.

Although the above description refers to the use of thyristors as switching elements, it will be clear to those skilled in the art that other switching devices could be used to implement the scheme. For example, a triac behaves in a basically similar manner to an inverse-parallel pair of thyristors, and so for lower current applications, a triac could in principle be used. Similarly, insulated gate bipolar transistors (IGBTs) are available with suitable current ratings, and so could also be used. However, in this case, the automatic switch-off at AC zero-crossings is not inherently provided by the IGBT device, and so additional drive circuitry may be required to provide the turn-off at AC zero crossings. The current sensing device 14 and the over-current detection circuit 15 of FIG. 1 are optional components, and are not required in order for the switching circuit 10 to provide the progressive increase in current to the load, which progressive increase may have advantages in reducing the stress on the load components.

The system as described here is for operation in single-phase AC systems. As the zero-crossings which give the system timing are timed differently in each phase of a multi-phase system, it would be necessary to use a separate switch for each phase. However, in a multi-phase system it would be possible to link the control circuits so that in the event of a fault in the AC load on one phase, all three switches could be prevented from closing. This could be required, for example, for safety reasons.

The derivation of the "ON" and "OFF" commands that operate the switch is outside the scope of this patent. However, it is clear to those skilled in the art that the commands could originate from any means, ranging from a local push-button to a signal sent by some communication means from a remote location.

In principle, the present invention is scalable and could be used in large scale AC power applications such as sub-stations, distribution, circuit breakers and the like.

The invention claimed is:

1. A switching arrangement comprising:

a control circuit;

a latching relay controlled by the control circuit for connecting an AC source to an AC load; and a relief circuit in parallel with the relay and controlled by the control circuit, wherein the relief circuit has two modes of operation: an inactive mode in which the relief circuit is non-conductive and an active mode in which the relief circuit is at least partially conductive, wherein the relief circuit is partially conductive when spending both a time period in a conductive state and a time period in a non-conductive state during a half-cycle of the AC, wherein the control circuit is configured to switch the relief circuit from inactive mode to active mode, and upon switching to active mode, to set the relief circuit as partially conductive for at least two half-cycles, wherein the proportion of time the relief circuit is conductive compared to non-conductive is increased for successive ones of the at least two half-cycles.

2. A switching arrangement according claim 1 wherein the control circuit is configured to control the switching of the relay on or off whereby (i) during a first time period prior to switching the relay on or off, the control circuit switches the relief circuit from inactive mode to active mode and (ii) during a second time period after switching the relay on or off, the control circuit switches the relief circuit from active mode to inactive mode.

3. A switching arrangement according to claim 2, wherein in controlling the switching of the relay on or off, the active mode is limited to a duration corresponding to 20 or less AC cycles.

4. A switching arrangement according to claim 2, wherein in controlling the switching of the relay on or off, the active mode is limited to a duration corresponding to 10 or less AC cycles.

5. A switching arrangement according to claim 2, wherein in controlling the switching of the relay on or off, the active mode is limited to a duration corresponding to 2 or less AC cycles.

6. A switching arrangement according to claim 1, wherein in the active mode, the relief circuit switches from conductive to non-conductive states coincident with the zero-crossings of the AC.

7. A switching arrangement claim 1, wherein the relief circuit comprises a thyristor pair, the thyristors connected with polarities reversed and in parallel; and wherein, in the active mode, the control circuit outputs a burst of pulses, each pulse initiating conduction of the thyristor pair until the following zero-crossing of the AC.

8. A switching arrangement according to claim 1, wherein when the switching arrangement is switched on, in the active mode, the relief circuit switches from conductive to non-conductive states at each zero-crossing of the AC applied to the switching arrangement; and wherein the proportion of time the relief circuit is conductive compared to non-conductive is increased for successive AC cycles by switching from non-conductive to conductive states progressively earlier relative to the zero crossing in successive AC cycles.

9. A switching arrangement according to claim 1, wherein when the switching arrangement is switched off, in the active mode, the relief circuit switches from conductive to non-conductive states at each zero-crossing of the AC applied to the switching arrangement; and wherein the proportion of time the relief circuit is conductive compared to non-conductive is decreased for successive AC cycles by switching from non-conductive to conductive states progressively later relative to the zero crossing in successive AC cycles.

10. A switching arrangement according to claim 1 and further comprising an overcurrent detection circuit configured to detect excessive current in the Active Mode when the switching arrangement is to be switched on and the relay closed, and to output a corresponding signal to the control circuit to abort the Active Mode and the closing of the relay.

11. A switching arrangement according to claim 1 and further comprising an over-current detection circuit configured to detect excessive current in the Inactive Mode when the switching arrangement is in the ON state and the relay closed, and to output a corresponding signal to the control logic to change the state of the switching arrangement from ON to OFF.

12. A switching arrangement according to claim 11, wherein the over-current detection circuit is configured to detect excessive current by:

measuring an absolute value of the current in the switch at any instant and comparing to a predetermined reference value, or deriving a signal corresponding to the rate of rise of the current during the beginning of a half cycle and predicting what the maximum value of the current in that half-cycle will be, and comparing to a predetermined reference value; or measuring an absolute value of the current in the switch at any instant and deriving a signal corresponding to the rate of rise of the current during the beginning of a half cycle and predicting what the maximum value of the current in that half-cycle will be, and summing the measured absolute value and the predicted maximum value and comparing the result with a predetermined maximum value.

13. A switching arrangement according to claim 1, wherein the relief circuit is conductive for a first period of time within each one of a first given number of half-cycles after changing from the inactive mode to the active mode, conductive for a second period of time within each one of a second given number of half-cycles subsequent to the first given number of half cycles, and wherein the second period of time is longer than the first period of time.

14. A switching arrangement according to claim 13, wherein the relief circuit is conductive for a third period of time within each one of a third given number of half-cycles subsequent to the second given number of half cycles, the third period of time being longer than the first and second periods of time.

* * * * *